US007823249B2

(12) United States Patent
Zahuranec et al.

(10) Patent No.: US 7,823,249 B2
(45) Date of Patent: Nov. 2, 2010

(54) MOTOR CONTROL FOR A VACUUM CLEANER

(75) Inventors: Terry L. Zahuranec, North Olmsted, OH (US); John A. Lambert, Strongsville, OH (US)

(73) Assignee: The Scott Fetzer Company, Westlake, OH (US)

( * ) Notice: Subject to any disclaimer, the term of this patent is extended or adjusted under 35 U.S.C. 154(b) by 1338 days.

(21) Appl. No.: 11/325,826

(22) Filed: Jan. 5, 2006

(65) Prior Publication Data

US 2007/0151068 A1 Jul. 5, 2007

(51) Int. Cl.
*A47L 5/00* (2006.01)
*A47L 7/00* (2006.01)

(52) U.S. Cl. ..... 15/319; 15/339

(58) Field of Classification Search ..... 15/319, 15/339; *A47L 5/00, 7/00*
See application file for complete search history.

(56) References Cited

U.S. PATENT DOCUMENTS

| | | | | |
|---|---|---|---|---|
| 2,789,660 | A | | 4/1957 | Brown |
| 3,695,006 | A | | 10/1972 | Valbona et al. |
| 4,020,525 | A | | 5/1977 | Fromknecht et al. |
| 4,654,924 | A | | 4/1987 | Getz et al. |
| 4,733,430 | A | | 3/1988 | Westergren |
| 4,920,605 | A | | 5/1990 | Takashima |
| 4,958,406 | A | | 9/1990 | Toyoshima et al. |
| 4,969,229 | A | | 11/1990 | Svanberg et al. |
| 4,969,797 | A | | 11/1990 | Takara et al. |
| 5,072,484 | A | | 12/1991 | Edlund |
| 5,243,732 | A | | 9/1993 | Koharagi et al. |
| 5,265,305 | A | | 11/1993 | Kraft et al. |
| 5,323,483 | A | * | 6/1994 | Baeg ..... 388/811 |
| 5,355,548 | A | | 10/1994 | Dekker |
| 5,507,067 | A | | 4/1996 | Hoekstra et al. |
| 5,515,572 | A | | 5/1996 | Hoekstra et al. |
| 5,542,146 | A | | 8/1996 | Hoekstra et al. |
| 5,664,282 | A | | 9/1997 | Castwall et al. |
| 5,737,798 | A | | 4/1998 | Moren et al. |
| 6,517,640 | B2 | | 2/2003 | Deng |
| 6,571,422 | B1 | | 6/2003 | Gordon et al. |
| 6,642,681 | B2 | | 11/2003 | Kawabata et al. |
| 6,777,844 | B2 | | 8/2004 | Selewski et al. |
| 2002/0042965 | A1 | | 4/2002 | Salem et al. |

FOREIGN PATENT DOCUMENTS

| | | | |
|---|---|---|---|
| JP | 04197229 | * | 4/1992 |

* cited by examiner

*Primary Examiner*—David A Redding
(74) *Attorney, Agent, or Firm*—Jones Day

(57) ABSTRACT

A vacuum cleaner includes a nozzle, an air-filtering dirt receptacle, and a motor. A fan is configured to be driven by the motor to drive a flow of air that carries dirt from a surface through the nozzle and into the receptacle to clean the surface. A controller is configured to provide a notification to a user when the speed of the motor exceeds a threshold value.

10 Claims, 1 Drawing Sheet

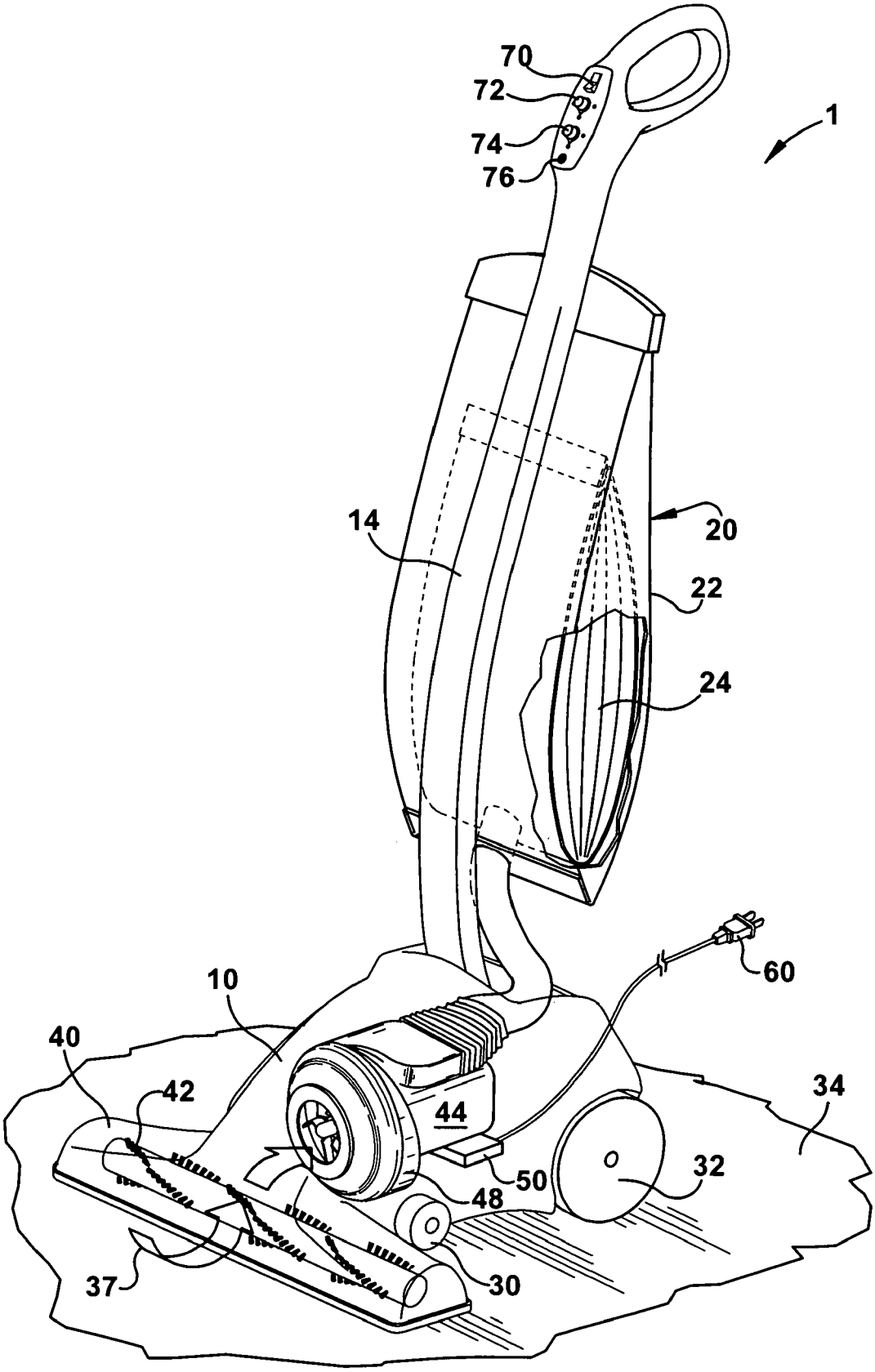
70
72
74
76
1
14
20
22
24
60
10
40
42
44
34
50
32
48
37
30

MOTOR CONTROL FOR A VACUUM CLEANER

TECHNICAL FIELD

This application relates to vacuum cleaners.

BACKGROUND

A vacuum cleaner cleans a floor by generating a flow of air that carries dirt from the floor into a filter bag.

SUMMARY

A vacuum cleaner includes a nozzle, an air-filtering dirt receptacle, and a motor. A fan is configured to be driven by the motor to drive a flow of air that carries dirt from a surface through the nozzle and into the receptacle to clean the surface. A controller is configured to provide a notification to a user when the speed of the motor exceeds a threshold value.

In other vacuum cleaners, a controller provides a notification to the user indicative of an excessive amount of dirt in the receptacle when current drawn by the motor drops below a threshold value. Another controller controls the motor to maintain a constant motor temperature. Another controller monitors a motor temperature and varies speed of the motor to keep the motor temperature from exceeding a preset value.

BRIEF DESCRIPTION OF THE DRAWING

The drawing FIGURE is a perspective view of a vacuum cleaner.

DESCRIPTION

The apparatus 1 shown in the FIGURE has parts that are examples of the elements recited in the claims. The apparatus thus includes examples of how a person of ordinary skill in the art can make and use the claimed invention. It is described here to meet the requirements of enablement and best mode without imposing limitations that are not recited in the claims.

The apparatus 1 is a vacuum cleaner. It includes a base 10, a handle 14 projecting upward from the base 10, and a dirt receptacle 20. The receptacle 20 includes a permanent outer filter bag 22 and disposable inner filter bag 24, both air-filtering in that they pass air and retain dirt. The base 10 has front and rear wheels 30 and 32 for wheeling the base 10 over a floor 34, and a nozzle 40. A brushroll 42 in the nozzle 26 is driven by a motor 44. The motor 44 also drives a centrifugal fan 48.

In operation, the brushroll 42 rotates against the floor 34 to dislodge dirt from the floor 34. The fan 48 generates a flow 37 of air that carries the dirt from the floor 34, through the nozzle 40 and the fan 48, into the inner bag 24.

The motor 44 can be a universal motor. It is powered by an electronic controller 50 that receives wall current through a power cord 60. The controller 50 controls motor speed, i.e., rotational speed of the shaft of the motor 44, by adjusting voltage powering the motor 44 or by pulse-width-modulating a constant voltage applied to the motor 44. The controller 50 monitors the voltage applied to the motor 44, current and wattage drawn by the motor 44, motor speed, and motor temperature. Motor speed can be monitored with a Hall effect or optical sensor. Motor temperature can be a surface temperature at some location on the motor 44 as measured by a thermocouple or the temperature of cooling air exiting the motor 44.

The handle 14 has a power switch 70 by which a user controls the controller 50 to start and stop the motor 44. A speed select switch 72 on the handle 14 enables the user to select a motor speed setting, such as fast, medium and slow. A mode select switch 74 on the handle enables the user to select which one of several modes of operation the controller 50 will implement to control motor speed. The modes are 1) constant voltage, 2) constant current, 3) constant wattage, 4) constant speed and 5) constant temperature.

A bag full indicator 76 on the handle 14 lights to indicate a bag full condition. The indicator 76 can provide a notification relating to an excessive amount of dirt in the bag 22 or 24, such as by a message imprinted above the light 76 directing the user to empty the permanent bag 22 or check or replace the disposable bag 24. The determination of the bag full condition is based on motor speed being inversely related to load on the motor 44 applied by the fan 48, which is itself inversely related to the extent of blockage of air flow through the filter bags 22 and 24.

In the constant voltage mode, the controller 50 sets a voltage based on the motor speed setting selected by the user. For example, the set voltage can be 120 VAC for a higher speed, 110 VAC for medium speed, and 100 VAC for low speed. Alternatively, the set voltage can be the same for the different speed settings, with the a set PWM ratio (pulse width modulation ratio of on-time to total-time) based on the motor speed setting. For example, the PWM ratio could be 100% for higher speed, 90% for medium speed, and 80% for low speed. The controller maintains the set voltage and set PWM ratio even as current drawn by the motor 44 changes with changes in torque load to the motor 44. The controller 50 lights the indicator light 76 when the current drops below a threshold current value or the motor speed exceeds a threshold speed value. The threshold values are different for each speed setting. For example, the threshold speed value can be selected as equaling a new bag speed plus a set delta value. The new bag speed is what the motor speed is estimated to be at the selected speed setting when the filter bag is new and empty. The delta value is the same for all speed settings.

In constant current mode, the controller 50 sets a current. The set current can be higher for the high speed setting and lower for the low speed setting. The controller 50 varies the voltage or PWM ratio applied to the motor 44 to maintain the set current to the motor 44 even as motor torque changes. The controller 50 lights the indicator 76 when the voltage or PWM ratio or motor speed exceeds a threshold value.

In constant wattage mode, the controller 50 sets a wattage, which can be higher for the high speed setting and lower for the low speed setting. The controller 50 varies the voltage or PWM ratio applied to the motor 44 to maintain the set wattage even as motor torque changes. The controller 50 lights the indicator light 76 when the voltage or PWM ratio or motor speed exceed a threshold value.

In constant speed mode, the controller 50 sets a speed based on the motor speed setting selected by the user. The controller 50 varies the voltage or PWM ratio applied to the motor 44 to maintain the set speed even as motor torque changes. The controller 50 lights the indicator 76 when the voltage or current or PWM ratio drops below a threshold value.

In constant temperature mode, the controller sets a motor temperature. The controller 50 varies the voltage or PWM ratio, and thus the motor speed, to maintain, or at least not exceed, the set temperature even as motor torque changes. The controller 50 lights the indicator 76 when the applied voltage or PWM ratio or motor speed exceeds a threshold value.

In this example, the cleaner 1 is an upright vacuum cleaner with a nozzle 26 permanently part of the base 10. In another example, the nozzle 26 can be removed from the base 10 and replaced with an accessory hose. Or the nozzle 26 can be replaced with a hose attached to a power head that can move independently of the base 10 and that includes a brushroll and a motor driving the brushroll. Even when the hose or the power head are attached to the base 10, the controller 50 can use the bag full determination methods described above.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. A vacuum cleaner comprising:

a nozzle;

an air-filtering dirt receptacle;

a motor;

a fan configured to be driven by the motor to drive a flow of air that carries dirt from a surface through the nozzle and into the receptacle to clean the surface; and a controller configured to provide a notification to a user when the speed of the motor exceeds a threshold value;

wherein the notification is indicative of an excessive amount of dirt in the receptacle.

2. A vacuum cleaner comprising:

a nozzle;

an air-filtering dirt receptacle;

a motor;

a fan configured to be driven by the motor to drive a flow of air that carries dirt from a surface through the nozzle and into the receptacle to clean the surface; and a controller configured to provide a notification to a user when the speed of the motor exceeds a threshold value;

wherein the notification directs the user to empty the receptacle.

3. A vacuum cleaner comprising:

a nozzle;

an air-filtering dirt receptacle;

a motor;

a fan configured to be driven by the motor to drive a flow of air that carries dirt from a surface through the nozzle and into the receptacle to clean the surface; and a controller configured to provide a notification to a user when the speed of the motor exceeds a threshold value;

wherein the notification directs the user to replace the receptacle.

4. The cleaner of claim 1 wherein the controller powers the motor with a constant voltage.

5. The cleaner of claim 1 wherein the controller is configured to control the motor to draw a constant current.

6. A vacuum cleaner comprising:

a nozzle;

an air-filtering dirt receptacle;

a motor;

a fan configured to be driven by the motor to drive a flow of air that carries dirt from a surface through the nozzle and into the receptacle to clean the surface; and a controller configured to provide a notification to a user when the speed of the motor exceeds a threshold value;

wherein the controller is configured to control the motor to maintain a constant motor temperature.

7. The cleaner of claim 1 wherein the controller powers the motor to rotate at different user selectable speed settings, and the threshold value is different for each speed setting.

8. A vacuum cleaner comprising:

a nozzle;

an air-filtering dirt receptacle;

a motor;

a fan configured to be driven by the motor to drive a flow of air that carries dirt from a surface through the nozzle and into the receptacle to clean the surface; and a controller configured to control the motor to maintain a constant motor temperature.

9. The cleaner of claim 8 wherein the controller varies a pulse width modulation ratio to maintain the constant motor temperature.

10. The cleaner of claim 8 wherein the controller is configured provide a notification to a user when the voltage powering the motor exceeds a threshold value.

* * * * *